United States Patent [19]

Rogers

[11] Patent Number: 4,755,915

[45] Date of Patent: Jul. 5, 1988

[54] SELF-CONTAINED LIGHTING APPARATUS

[76] Inventor: Jo V. Rogers, 1185 Meadowsweet Dr., Corte Madera, Calif. 94925

[21] Appl. No.: 87,870

[22] Filed: Aug. 21, 1987

[51] Int. Cl.[4] ..... F21V 33/00

[52] U.S. Cl. ..... 362/155; 362/156

[58] Field of Search ..... 362/155, 156, 154

[56] References Cited

U.S. PATENT DOCUMENTS

| | | | |
|---|---|---|---|
| 4,167,774 | 9/1979 | Knuchel et al. | 362/155 |
| 4,178,626 | 12/1979 | Marcus | 362/155 |
| 4,316,239 | 2/1982 | Cass et al. | 362/155 |
| 4,442,478 | 4/1984 | Stansbury | 362/155 |
| 4,577,262 | 3/1986 | Buteaux | 362/155 |
| 4,648,012 | 3/1987 | Pittman, II | 362/155 |

*Primary Examiner*—E. Rollins Cross

*Attorney, Agent, or Firm*—Linval B. Castle

[57] ABSTRACT

A lighting fixture with self-contained batteries and mercury switch for attachment of the fixture to the interior surface of the door of a mailbox for illuminating the box interior when the door is opened. The mercury switch is manually adjustable about a lateral axis so that the fixture may be used on either front opening or top tilting doors.

9 Claims, 1 Drawing Sheet

SELF-CONTAINED LIGHTING APPARATUS

BRIEF DESCRIPTION OF THE INVENTION

This invention relates to lighting fixtures and in particular to a self-contained battery operated fixture that is switched between off and on by the tilting of the fixture itself.

The battery operated fixture of the invention is particularly useful for attachment to the doors of such containers as mailboxes where it may be desirable to view the interior before reaching inside.

It is not unusual to provide lighting fixtures that are switched by the opening and closing of a door as employed in home refrigerators or interior automobile lighting. It is also known to provide interior lighting to containers or boxes from battery sources that are switched by a door operated switch, as shown in U.S. Pat. No. 4,577,262, issued Mar. 18, 1986 to Buteaux. While the invention to be described is useful for the same application mentioned by Buteaux, it is designed primarily for use in mailboxes wherein the entire battery contained lighting fixture may be mounted on the interior of the box door and is switched between OFF and ON positions by a mercury switch contained within the fixture, the switch being activated by the tilting of the box door.

There are two principal forms of large residential type mailboxes: the rural type with the arcuate roof and the downward tilting front door, and the rectangular box with the upward tilting top door or lid. A mercury switch in a fixture mounted on the interior door surface of the first or rural type must turn the lamp off when the door is vertically closed and on when horizontally open, whereas a fixture mounted to the interior of a upward tilting lid of the rectangular box must reverse the operation and turn on the light when the door is vertical and turn it off when closed or nearly horizontal.

The self-contained lighting fixture to be described can be built in or easily retrofitted to either type of existing residential mailbox.

Briefly described, the preferred embodiment of the lighting fixture of the invention includes circuitry comprising two size AA batteries connected in series through a lamp to a small mercury switch and thence to back to the batteries. The circuitry is contained in a housing having a transparent or translucent lamp end section which is aligned to face into the mailbox to which the housing is attached. The mercury switch is pivotally connected to an interior side wall of the housing so that it may be manually adjusted over an angle of about 50° each side of the vertical to adapt the switch to either a front tilting door or top tilting lid box.

BRIEF DESCRIPTION OF THE DRAWINGS

In the drawings which illustrate the preferred embodiment of the invention.

DETAILED DESCRIPTION

Figure 1:
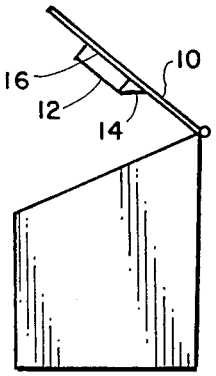
FIG. 1 is a side elevational view of a typical rectangular box type mailbox with a lighting fixture attached to the upward tilting lid.

Illustrated in FIG. 1 is a typical rectangular storage box or mailbox with an upward tilting lid 10. Attached by screws or an adhesive to the interior surface of the lid is a lighting fixture 12 in accordance with the invention. The fixture 12 is preferably rectangular and has a transparent end 14 through which a battery powered lamp illuminates the box interior when the lid 12 is tilted toward the vertical. As illustrated, the end 14 is slanted to form a long bottom fixture surface 16 which is the surface attached to the interior of the box lid 10. A battery access door is on the fixture top surface as will be later described in connection with FIG. 8.

Figure 2:
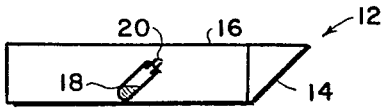
FIG. 2 is a simplified sectional drawing of the lighting fixture in a horizontal position when attached to the interior lid of the box of FIG. 1 and illustrates the lamp mercury switch in an OFF position.

FIG. 2 is a simplified schematic elevational view of the portion of the interior of the lighting fixture 12 of FIG. 1 when attached to the mailbox lid 10 in a closed or near horizontal position. Contained within the lighting fixture is a small mercury switch 18 comprising a short nonconductive sealed tube with a pair of electrical conductors 20 sealed into one end of the tube and extending into the tube interior. A drop of mercury within the sealed tube will electrically interconnect the two conductors 20 only when the tube is positioned so that the mercury gravitates toward the conductors 20; the circuit between the two conductors is open when the mercury gravitates toward the opposite end of the tube, away from the conductors 20, as illustrated in FIG. 2.

Thus, when the mailbox lid 10 is closed, the fixture 12 is near the horizontal and, because the axis of the gravity operated mercury switch 18 is oriented to be substantially parallel with the slanted end 14 of the fixture as illustrated in FIG. 2, the switch 18 is OFF and there is no current flow to the lamp within the lighting fixture.

Figure 3:
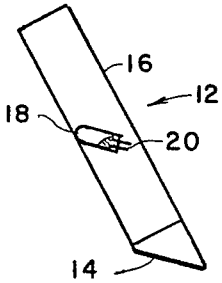
FIG. 3 illustrates the fixture of FIG. 2 when the box lid is raised and the switch is in an ON position.

FIG. 3 illustrates position of the fixture 12 when the mailbox lid 10 of FIG. 1 is opened by being tilted toward the vertical. The long axis of the switch 18 is still substantially parallel with the slanted lighted end 14 of the fixture, but the tilt of the box lid has caused the mercury within the switch to gravitate to electrically interconnect the conductors 20 so that current may flow to a lamp in the fixture to illuminate the interior of the mailbox.

Figure 4:
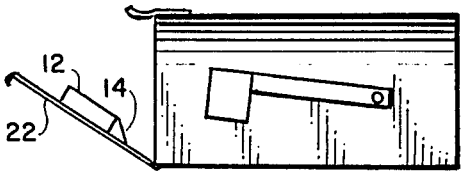
FIG. 4 is an elevational view of a typical rural type mailbox with the lighting fixture attached to the interior of the forward tilting door.

FIG. 4 is an elevational view of a mailbox having an arcate roof and a downward tilting front door 22. Attached to the interior of the door is the lighting fixture. Since the same lighting fixture is usuable on both the boxes of FIG. 1 and FIG. 4, the reference numbers applied to the fixture of the previous figures will be contained in the following descriptions.

Figure 5:
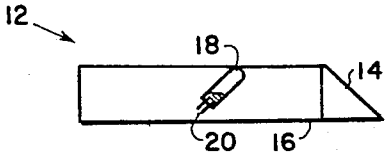
FIG. 5 is a simplified schematic drawing of the lighting fixture in a horizontal position with the mercury switch in its ON position.

In FIG. 4, the transparent end 14 of the fixture 12 slants down toward the long surface 16 which is secured to the mailbox door 22. When the mailbox door 22 is open the fixture 12 approaches the horizontal as shown in FIG. 5, and the mercury switch 18 must be positioned so that the switch's electrical conductors 20 are in contact with the mercury within the switch so that the fixture lamp is energized to illuminate the interior of the box. As shown in FIG. 5, the mercury switch 12 is now aligned so that its longitudinal axis is substantially perpendicular to the angle of the slanted end 14, as opposed to the parallel positioning of the switch in FIGS. 2 and 3.

Figure 6:
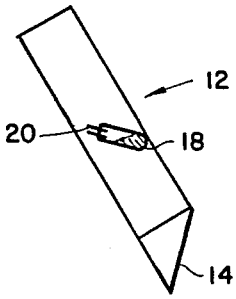
FIG. 6 illustrates the fixture of FIG. 5 with the switch OFF when the door is tilted toward its closed position.

FIG. 6 illustrates the condition of the switch 18 when the mailbox door of FIG. 4 approaches its closed or vertical position at which the lamp in the fixture is to be extinguished. Note that as the fixture is tilted toward the vertical, the mercury within the switch gravitates away from the conductors 20 to open the electrical circuit to the lamp in the fixture.

Figure 7:
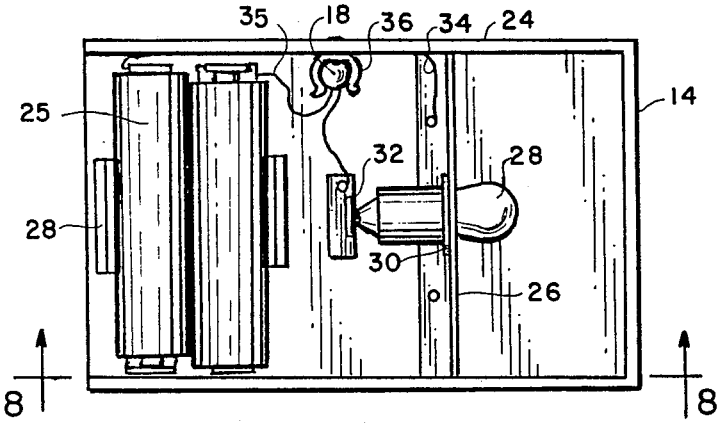
FIG. 7 is a plan view of the interior of the lighting fixture of the invention.

FIG. 7 is a sectional plan view of the preferred embodiment of the interior of the lighting fixture and illustrates a rectangular plastic housing 24 having at one end a pair of adjacently positioned size AA batteries 25 mounted parallel to each other in a suitable battery clip 28 but electrically connected in series. The end of the housing 24 opposite the location of the batteries 25 is the slanted transparent end 14 and separating the end 14 from the main body of the housing is a vertical metal wall 26 preferably riveted to the floor of the housing. A central opening in the wall 26 is provided to receive a small flashlight bulb 28 having a conventional axial flange 30 which is electrically connected to one end of the lamp filament and which abuts against the metal wall 26 within the main body of the housing. The opposite bulb filament is connected within the lamp housing to the axial end contact of the lamp and contacts a vertical standing resilient lamp terminal 32 which is attached to the interior floor of the housing. Thus, the bulb 28 is held in place within the opening in the wall 26 by forcing it between the wall 26 and the resilient conductive terminal 32.

A small electrical wire 34 connects the megative terminal of the series batteries 25 to the metal wall 26 and therefore to the conductive flange 30 of the lamp 28. Another wire 35 connects the positive terminal of the batteries to the lamp terminal 32 through the mercury switch 18.

Figure 8:
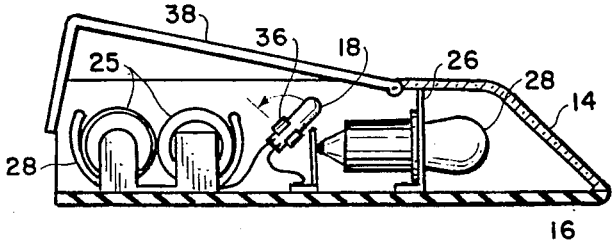
FIG. 8 is an elevational view taken along the lines 8—8 of FIG. 7.

The mercury switch 18, which has previously been described, is preferably mounted in a fuse clip 36 which is tightly secured to a side wall of the housing 14 by a single rivet so that, with little effort, the clip 36 and switch 18 may be rotated about 50° each side of the vertical as best shown in the elevational view of FIG. 8. The switch 18 may therefore be manually adjusted between the position shown in FIG. 5 to that shown in FIG. 2 so that it is readily adaptable for use on either the front tilting door of FIG. 4 to the top tilting lid of FIG. 1.

FIG. 8 is a sectional elevational view of the fixture taken along the lines 8—8 of FIG. 7 and better illustrates the transparent or transluscent end 14 of the housing and the approximate swing of the mercury switch 18 between a position substantially parallel with the slanted transparent end 14 and one substantially perpendicular thereto. Also illustrated in FIG. 8 is door 38 formed in the top surface of the housing and enclosing the battery section. The door 38 should be sufficiently long to permit replacement of batteries 25, the lamp 28, and the adjustment of the mercury switch 18. The door may be hinged to the housing at any convenient location and must contain some type of latch to secure the door closed when the fixture 12 is tilted or inverted.

Figure 9:
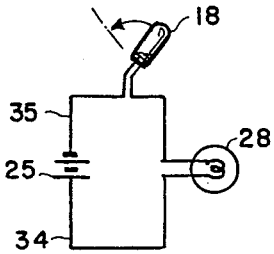
FIG. 9 is an electrical schematic diagram of the lighting fixture of the invention and illustrates the adjustable mercury switch.

FIG. 9 is an electrical schematic diagram of the battery-powered light fixture illustrating the series connected manually pivotable mercury switch 18, and batteries 25, the lamp 28, and the interconnecting wiring thereto.

Having thus described may invention, what I claim is as follows:

1. A battery powered lighting fixture electrically switchable by the tilting of the fixture, said fixture comprising:

a housing having a first end through which light energy may be transmitted;

a light bulb within said housing, said bulb being positioned to connected to said light bulb; and a battery within said housing, said battery being electrically connected to said light bulb; and switch means attached to said housing and coupled between said battery and said light bulb, said switch means being electrically opened and closed by the tilting of said housing at a predetermined angle with respect to the horizontal.

2. The lighting fixture claimed in claim 1 wherein said switch means is a mercury switch comprising a tubular element having a longitudinal axis and a pair of switch conductors within said element and adjacent a first end of said element.

3. The lighting fixture claimed in claim 2 wherein said fixture housing has a floor and side walls substantially perpendicular to said floor, and wherein said mercury switch is secured to one of said side walls and is electrically switched by the rotation of said floor about a lateral axis perpendicular to said side walls.

4. The lighting fixture claimed in claim 3 wherein said mercury switch is manually rotatable about a lateral axis for altering the desired angle at which said switch is electrically opened and closed.

5. The lighting fixture claimed in claim 4 wherein said housing has a door giving access to said battery, said light bulb and said mercury switch.

6. The lighting fixture claimed in claim 5 wherein the first end of said is transparent.

7. A battery powered lighting fixture for attachment tothe interior of a hinged door of a box for illuminating the interior of said box upon the opening of said door, said lighting fixture including:

an elongated housing having a floor, side walls, a top and first and second ends, said first end being slanted down from the housing top to the floor and being at least transluscent for the transmission of light from a source within said housing;

a light bulb mounted within said housing and positioned to radiate light through said first end;

at least one battery removably located within said housing, said battery being electrically connected to said light bulb;

a mercury switch connected between one terminal of said battery and one terminal of said light bulb, said switch being mounted to an interior surface of a housing side wall; and means for manually adjusting said mercury switch about a lateral axis normal to said side walls for selecting a desired angle of the box door at which said switch will electrically close and open.

8. The lighting fixture claimed in claim 7 wherein said mercury switch may be adjusted to control said fixture on front-opening box doors and top-tilting box doors.

9. The lighting fixture claimed in claim 8 further including a hinged door in the top of said housing for providing access to said battery, said light bulb, and said mercury switch.

* * * * *